US005642579A

United States Patent [19]

Netten et al.

[11] Patent Number: 5,642,579

[45] Date of Patent: Jul. 1, 1997

[54] STEAM IRON HAVING A FABRIC TEMPERATURE SENSOR FOR CONTROLLING STEAM PRODUCTION

[75] Inventors: Adriaan Netten; Hong W. C. Tse, both of Singapore, Singapore

[73] Assignee: U.S. Philips Corporation, New York, N.Y.

[21] Appl. No.: 590,255

[22] Filed: Jan. 23, 1996

[30] Foreign Application Priority Data

Jan. 23, 1995 [EP] European Pat. Off. ..... 95200147

[51] Int. Cl.[6] ..... D06F 75/26

[52] U.S. Cl. ..... 38/77.7; 38/93

[58] Field of Search ..... 38/77.7, 77.8, 38/77.82, 93; 219/245, 248, 251, 259, 256

[56] References Cited

U.S. PATENT DOCUMENTS

| | | | |
|---|---|---|---|
| 4,835,363 | 5/1989 | Hoffmann | 38/88 X |
| 5,042,179 | 8/1991 | Van Der Meer | 38/77.83 |
| 5,391,859 | 2/1995 | Hazan et al. | 38/82 X |

FOREIGN PATENT DOCUMENTS

| | | | |
|---|---|---|---|
| 3267098 | 11/1991 | Japan | 38/93 |
| 4005998 | 1/1992 | Japan | 38/93 |

*Primary Examiner*—Ismael Izaguirre
*Attorney, Agent, or Firm*—Ernestine C. Bartlett

[57] ABSTRACT

Steam iron having an electrically heated soleplate (2), a steam generator (6) comprising a water tank (8), a water pump (10) and a steam chamber (12) for supplying steam via steam vents (20) in the soleplate (2). The steam production is made dependent on the temperature of the fabric a fabric temperature sensor (24) embedded in the soleplate (2). A cool fabric triggers the production of steam. The production is stopped as soon as the fabric temperature reaches the condensing temperature of steam. Since no more steam is absorbed in the fabric when the condensing temperature is reached, any more steam production is waste of water and power. In this way any further steam production is prevented and waste of water and power is avoided. After steaming has stopped the fabric temperature sensor (24) can be advantageously used to control the drying power of the soleplate (2) to avoid scorching of the fabric and to avoid waste of power.

16 Claims, 4 Drawing Sheets

STEAM IRON HAVING A FABRIC TEMPERATURE SENSOR FOR CONTROLLING STEAM PRODUCTION

BACKGROUND OF THE INVENTION

The invention relates to a steam iron comprising a soleplate provided with steam vents for passing steam to a fabric to be ironed and a steam generator for supplying an adjustable amount of steam to the steam vents.

Such a steam iron is known from U.S. Pat. No. 5,042,179. In ironing of clothing three different processes can be distinguished: conditioning of the fibres, relaxation of the fibres and fixation of the fibres. During the conditioning the fibres are prepared for the relaxation. The conditioning is done by increasing the temperature of the fibres in order to make the fibres weak enhancing the recovery, during the relaxation, from the plastic deformation of the fibres caused by wearing of the clothing. The use of steam is an effective way to increase the temperature. Moreover, the weakness of some fibres increases with the water content as well, especially for cotton, linen, viscose and wool. After the conditioning the relaxation or real ironing takes place. During the relaxation the weak fibres are being pressed between the soleplate and the ironing board. This should last sufficiently long to allow the fibres to recover from the plastic deformation. The moisture content of the fabric should not decrease too fast during relaxation in the case of cotton, linen and wool as this would adversely affect the relaxation process. After relaxation the opposite from the conditioning takes place. This means that the weakness of the fibres is decreased to prevent the occurrence of wrinkles again. The fixation comprises the drying of the fibres, followed by cooling down.

During the conditioning the temperature of the fabric increases to about 100° C. partly by condensation of steam and partly due to heating by the soleplate. During the relaxation the temperature should be kept at about 100° C. to maintain both a high temperature and a high moisture content of the fabric providing for a fast recovery of the fibres. After the relaxation the fabric is being dried, indicated by a temperature increase in the fabric above 100 ° C., and followed by cooling down to assure a proper fixation. This cooling down takes place partly on the ironing board and partly after removal of the cloth from the board to clear the board for the next cloth.

In conventional steam irons the steam rate is set and the iron is moved forwards and backwards over the fabric. In the forward stroke the amount of steam is insufficient in most cases to heat the fabric up to 100° C., whereas after passing the steam vents the fabric is heated further by the sole plate to a higher temperature close to 100° C. In the backward stroke the production of steam still continues, but the fabric has already reached 100° C. and will not adsorb water any more. Although it does not affect the fabric, steam is wasted that could have been used to warm up and to moisten more intensively the fabric in order to obtain a weaker fabric at a higher temperature during the forward stroke. A lot of unused steam is blown through the fabric into the ironing board and to the surrounding air without the desired condensation onto and in the fabric. A lot of heat and water is wasted and should be avoided.

In the above mentioned known steam iron waste of steam is reduced by controlling the amount of steam produced by the steam generator as a function of time. The steam production is controlled by regulating the output power of the heating element of the steam chamber from a high initial level to a low or zero level during an ironing cycle. It is further known from said known steam iron to adapt the steam production to the amount of heat required to heat the fabric by measuring the power need of the heating element of the soleplate. Such measuring however is inaccurate and slow.

SUMMARY OF THE INVENTION

It is an object of the present invention to provide a steam iron having an accurate and effective steam generation for moistening and heating up the fabric to be ironed. According to the invention the steam iron as specified in the opening paragraph is characterized in that the steam iron further comprises a fabric temperature sensor for detecting the temperature of the fabric to be ironed and control means responsive to a signal from the fabric temperature sensor for controlling the amount of steam passing to the steam vents.

In the steam iron according to the invention the temperature of the fabric determines the amount of steam that is passed through the steam vents. Both heating up and moistening of the cool fabric to be ironed is accomplished by means of steam, although some heating by the soleplate is unavoidable. The temperature of the fabric is sensed by the fabric temperature sensor and when a temperature of about 100° C. is reached the steaming is stopped. In this way no steam is produced when the fabric has reached a temperature (the condensing temperature of steam) at which no water is adsorbed any more. As the steam production is dependent on the temperature of the fabric to be ironed, a dial or knob for setting the steam rate is no longer necessary. A cool cloth automatically triggers the production of steam and the steam production is shut off automatically when the temperature of the cloth reaches the desired temperature. By obtaining a fabric temperature of 100° C. with steam only, the weakest fibres in the shortest time are provided. This results in a very good ironing result in a short time. In practice the actual temperature may be somewhat lower than the nominal condensing temperature of 100° C., for instance 95° C.

Preferably the fabric temperature sensor is embedded in the soleplate and has a temperature sensitive surface which touches the fabric during ironing and preferably the fabric temperature sensor is positioned in the front portion of the soleplate nearby the steam vents. Assuming that the capacity of the steam generator is sufficient, it is possible to heat up and to moisten the fabric in the forward stroke of the steam iron. At the end of the forward stroke the steaming stops and the fabric is ready for being dried in the next backward stroke. The fabric temperature sensor is placed near the steam vents for measuring the temperature of the fabric due to steaming. However other positions may work as well.

The steam generation can be done in several ways known per se. A possible way is the use of a separate steam chamber coupled to the steam iron with a hose. In that case the control means for controlling the amount of steam passing to the steam vents may comprise a steam valve which is opened and closed in response to the signal from the fabric temperature sensor. A preferred embodiment is characterized in that the steam generator comprises a water tank for containing water to be converted into steam, a steam chamber for converting the water into steam and a water pump for pumping water from the water tank to the steam chamber, the water pump being operable in response of a pump activation signal derived from the signal from the fabric temperature sensor. This embodiment is suitable for use in stand-alone steam irons with built-in water tank and steam chamber.

After conditioning and relaxation the fabric has to be dried and cooled down for a proper fixation of the fibres. This drying can be done in conventional way by the heat of the soleplate, which heat is set by means of a dial. In that case the heat of the sole plate is also effective during the previous automatic steaming action and the cloth is not only heated up by condensing steam, but also by heat from the soleplate. For a good result the fabric end temperature does not have to be far above 100° C. All heating power necessary to raise the fabric temperature slightly above that temperature is waste of power and increases the risk of scorching and should be avoided.

In order to avoid power waste and scorching an embodiment of the steam iron according to the invention is additionally characterized in that the steam iron further comprises a heating element for heating the soleplate and second control means responsive to the signal from the fabric temperature sensor for controlling the amount of heat produced by the soleplate. The fabric temperature sensor is also used for regulating the power of the heating element of the soleplate. By monitoring the fabric temperature during drying as much power as needed to dry the fabric is used and scorching is prevented. A temperature dial may be dispensed with as the power is shut off automatically when a predetermined temperature above 100° C. is sensed by the fabric temperature sensor. This predetermined temperature should be low enough to prevent scorching, but every temperature above 100° C. will do. In case of a conventional soleplate with the corresponding slow temperature response, this temperature may be in the range of 120° C. to 150° C. to assure drying without scorching when the iron is moved backwards and forwards.

A virtually instantaneous control of heat transfer from the iron to the fabric is obtained in an embodiment which is characterized in that the soleplate is a low heat capacity type soleplate. For this purpose the steam iron may have a thin soleplate heated by halogen lamps or thick film heating elements. The power control feature in combination with the steam control feature provides a steam iron with the possibility to heat up and moisten the fabric in the first forward stroke by steaming only and to dry the fabric in the same first forward stroke or in the first backward stroke and in any following forward and backward strokes, if needed, by heating only. In this way a very efficient and fast ironing performance is achievable. In order to measure the temperature of the fabric more accurately during drying, a second fabric temperature sensor mounted at the back portion of the soleplate may be provided. The highest temperature of both sensors can be used to control the amount of heat of the soleplate. A more sophisticated power control is obtained in an embodiment which is characterized in that the steam iron further comprises a motion direction sensor for discriminating motion in the forward and backward direction of the iron, the second control means being responsive to the signal from the first fabric temperature sensor during motion in the backward direction and being responsive to a signal from the second fabric temperature sensor during motion in the forward direction. The heat is controlled by the second sensor in the back portion of the soleplate during forward strokes and by the first sensor in the front portion of the soleplate during backward strokes.

The means for controlling the amount of steam and the means for controlling the amount of heat may respond conventionally or according to fuzzy logic rules to the temperature and the temperature gradient of the fabric sensed by the fabric temperature sensor or sensors.

BRIEF DESCRIPTION OF THE DRAWING

The above and other features and advantages of the invention will be apparent from the following description of exemplary embodiments of the invention with reference to the accompanying drawings, in which.

Like reference symbols are employed in the drawings and in the description of the preferred embodiments to represent the same or very similar item or items.

DETAILED DESCRIPTION OF THE PREFERRED EMBODIMENT

Figure 1:
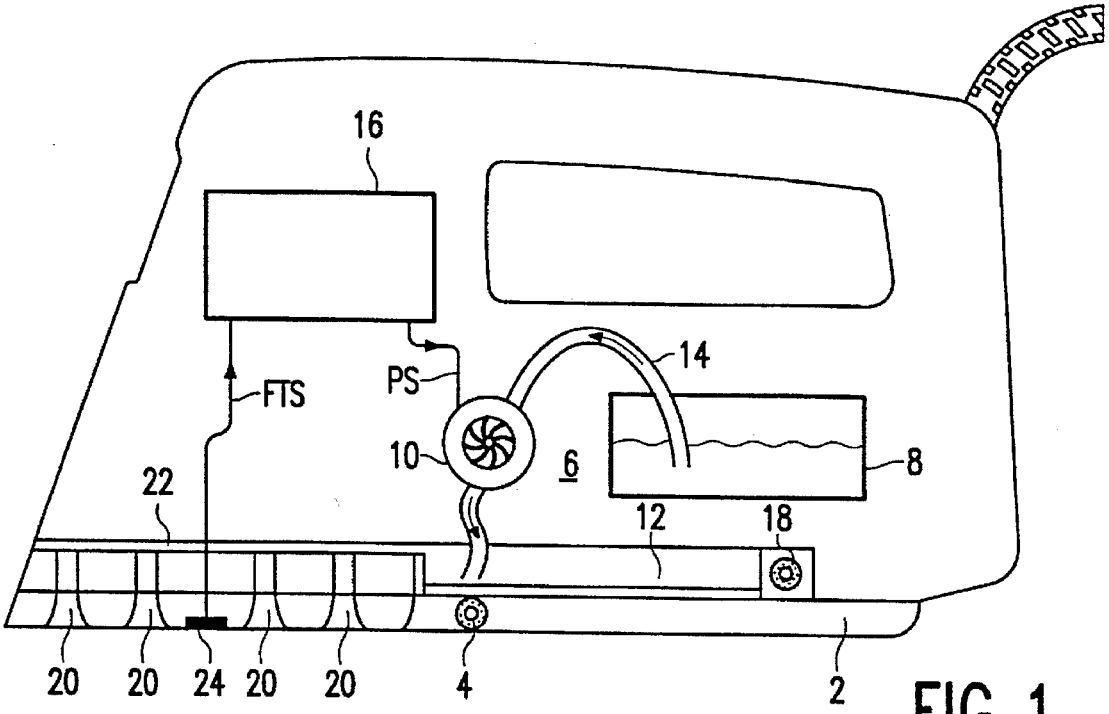
FIG. 1 shows schematically a cross section of a first embodiment of a steam iron according to the invention.
Figure 2:
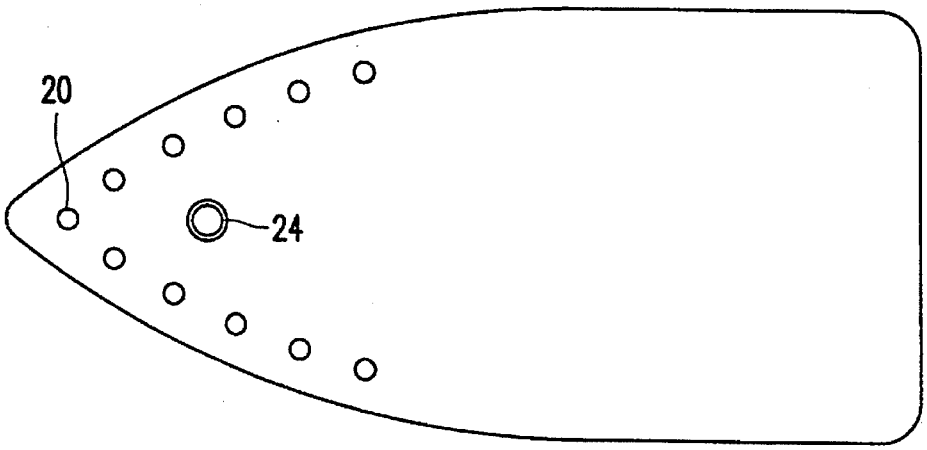
FIG. 2 shows a bottom view of the soleplate of a steam iron according to the invention.
Figure 3:
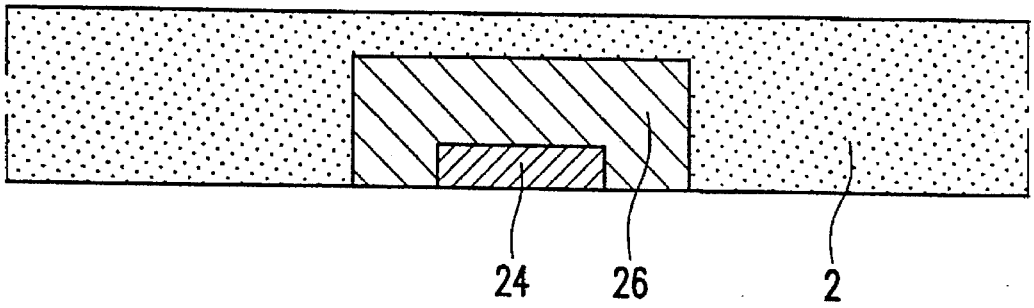
FIG. 3 shows a fabric temperature sensor embedded in the soleplate of a steam iron according to the invention.

FIG. 1 shows a first embodiment of a steam iron according to the invention having fabric temperature dependent steam generation. The steam iron has a conventional soleplate 2 which is heated by an electrical heating element 4. The temperature of the soleplate 2 is kept at a desired temperature by means of a conventional thermostat (not shown) and a temperature dial (not shown) as known from the art of conventional steam irons. However, other known means to control the temperature of the soleplate 2 can also be employed, such as full electronic control with a triac, a temperature sensor for measuring the temperature of the soleplate and an adjustable reference for changing the desired temperature of the soleplate. Steam is generated by a steam generator 6 which comprises a water tank 8, a water pump 10 and a steam chamber 12. The water pump 10 pumps water from the water tank 8 to the steam chamber 12 via a hose 14 under command of a pump signal PS from a controller 16. The steam chamber 12 is heated with a heating element 18 controlled by a conventional thermostat (not shown), but an electronic control can be employed as well. The steam from the steam chamber 12 reaches steam vents 20 via a steam duct 22. A fabric temperature sensor 24 is embedded in the front portion of the soleplate 2 and is surrounded by the steam vents 20 as shown in FIG. 2. The fabric temperature sensor 24 slightly touches the fabric during ironing and sends a fabric temperature signal FTS to the controller 16 which is indicative of the actual temperature of the fabric being ironed. FIG. 3 shows the embedded fabric temperature sensor 24 in more detail. The fabric temperature sensor 24 is thermally insulated from the soleplate 2 by means of thermal insulation material 26 which also provides a rigid mechanical mounting of the fabric temperature sensor 24 in the soleplate 2. The fabric temperature sensor 24 should have a low thermal inertia for fast response and correct temperature measurements of the fabrics being ironed. The fabric temperature sensor 24 may be a resistor with a positive temperature coefficient (PTC) or a negative temperature coefficient (NTC) of suitable dimensions. A thermo-couple or a contact-less infra red sensor may be used as well.

All electrical parts, such as the heating element 4, the heating element 18, the water pump 10 and the controller 16 receive suitable AC or DC supply voltages in a conventional manner not shown. The steam generator 6 can alternatively be a detached steam generator connected to the iron with a hose. In that case the steam is passed to the steam duct 22 via a controllable steam valve under control of a signal having a similar function as the pump signal PS.

During ironing a cool cloth is placed on the ironing board. As soon as the soleplate 2 touches the cool cloth the relatively low temperature of the cloth is sensed by the fabric temperature sensor 24 and the corresponding fabric temperature signal FTS signals the controller to activate the water pump 10 by sending the pump signal PS to the water pump 10. The water is converted to steam in the hot steam chamber 12 and hot steam reaches the cloth via the steam duct 22 and the steam vents 20. The steam condenses in the cool cloth and heats up the cloth. The cloth is also partly heated up by the hot soleplate. The capacity of the steam generator determines the maximum available amount of steam. A high capacity is advantageous as this results in a cloth which is heated up nearly by condensing steam only. In that case the cloth contains much water which is beneficial to the weakening of the fibres of the cloth. The higher the amount of steam, the higher the fabric temperature will be up to 100° C. by condensing steam. The temperature of the cloth will not exceed 100° C. by using more steam. Any further steam production is wasting of power and water. This waste is avoided according to the invention by sensing the temperature of the cloth. When the fabric temperature signal FTS from the fabric temperature sensor 24 signals the condensing temperature of steam (about 100° C.), the controller 16 stops the production of steam by sending an appropriate pump signal PS to the water pump 10. From now on the cloth is dried by the hot soleplate 2. The fabric temperature sensor 24 avoids waste of steam and waste of power. A steam rate dial is superfluous since steam production is automatically engaged by the sensing of a cool cloth and automatically stopped by the sensing of the steam condensing temperature in the cloth. The amount of steam can further be made dependent on the temperature gradient, that is the temperature increase per unit of time, of the cloth. In this way the differences in steam adsorption of different clothing can be taken into account and a better forecast of the moment to stop the steam production is possible.

Preferably the steam production is controlled according to fuzzy logic rules using the temperature of the cloth and the temperature gradient of the cloth as input parameters having ranges which are divided in subranges. The membership of the input parameters of a subrange determines the action to be executed. The action is described in a rule base. Such a rule might be: if fabric temperature is cold and fabric temperature gradient is small then steam production is high. Fuzzy logic control is a well known technique which needs no further explanation. Using fuzzy logic the steam production is controlled as follows:

- If temperature of fabric <100° C.: increase the steam production depending on the fabric temperature and the gradient of the fabric temperature;
- If temperature of fabric ≈100° C.: step down steam production;
- If temperature of fabric >100° C.: stop steam production because no further condensation of steam in the fabric is possible.

It is to be noted that in practice the value of the reference temperature can be somewhat lower, for instance 95° C., than the theoretical temperature value (100° C.) of condensing steam.

During drying of the fabric the temperature increases and the moisture in the fabric evaporates. When all moisture has been evaporated the temperature of the fabric rises quickly above 100° C. Any more heating up of the fabric is superfluous and is waste of power. In addition the risk of scorching is increased. In order to avoid power waste and to reduce the risk of scorching the fabric temperature sensor 24 may be used advantageously to control the heating element 4 of the soleplate 2 by keeping track of the fabric temperature after steaming was stopped. The raise above 100° C. of the temperature of the fabric can be used to stop or to reduce the power of the heating element 4 of the soleplate 2. The fabric temperature at which the power to the heating element 4 is to be stopped should be high enough to assure a fully dried fabric and should be not so high as to cause scorching. In principle any value above 100° C. will do, but with a conventional soleplate and its corresponding rather slow temperature decay, a power-off fabric temperature in the range from 120° C. to 150° C. is a good choice to assure that the fabric is dry and to be sure that the fabric is not scorched as long as the iron is moving over the fabric.

Figure 4:
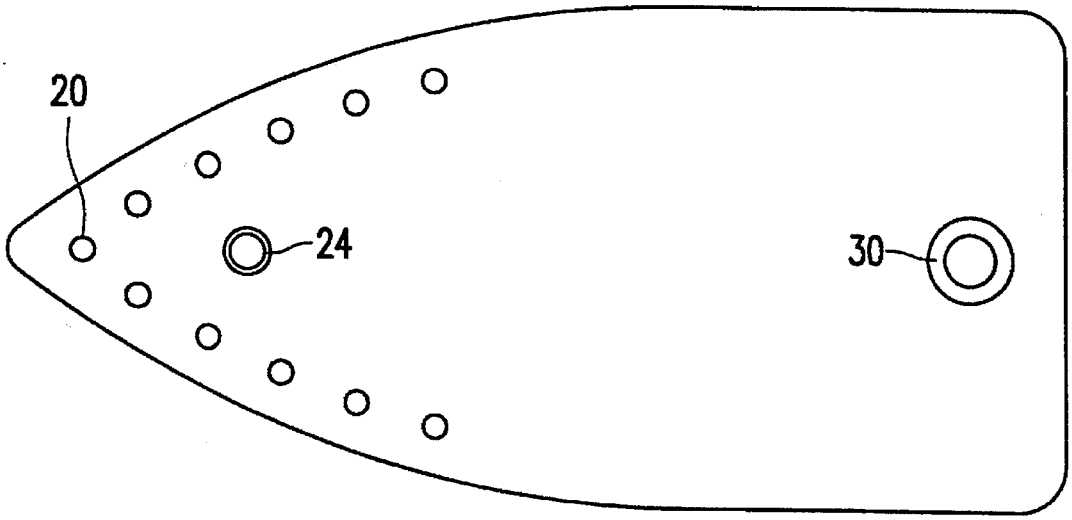
FIG. 4 shows a bottom view of an alternative version of the soleplate of a steam iron according to the invention.

The fabric temperature sensor 24 is thus not only used to control the steam production, but also to control the heat production of the soleplate. A temperature dial may be dispensed with since the power of the soleplate is switched off automatically when the temperature of the fabric reaches a predetermined value above 100° C. The fabric temperature sensor 24 is positioned in the front portion of the soleplate 2 and is surrounded by the steam vents 20, so that the fabric temperature is measured accurately during steaming. When the steam production has ended, the temperature of the fabric is measured by the same fabric temperature sensor 24. For this purpose the front position of the fabric temperature sensor 24 is optimal if the iron is moved backwards over the fabric, because temperature sensing is done after heating by the heating zone of the soleplate 2. However, a second fabric temperature sensor positioned in the back portion of the soleplate, as shown in FIG. 4, can be used to measure the temperature of the fabric during the forward stroke. By taking the highest of the two temperatures a correct temperature is obtained in both forward and backward strokes.

Figure 5A:
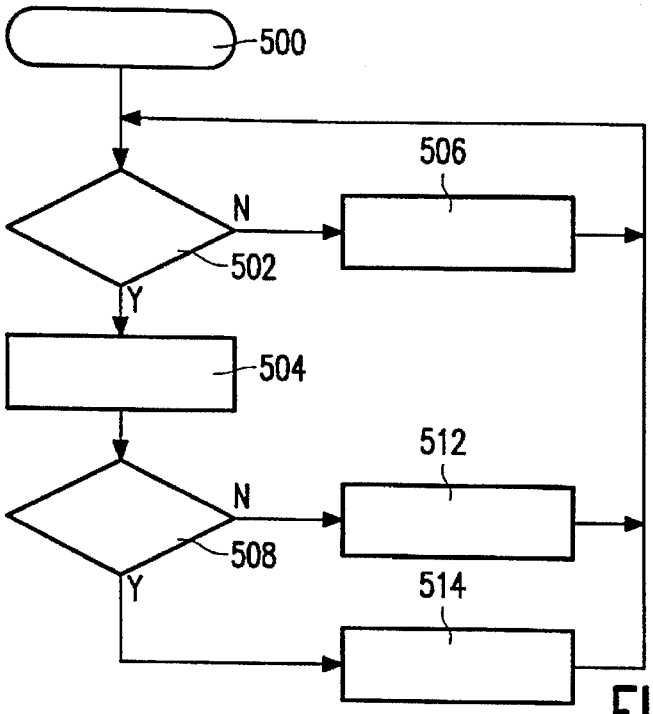
FIG. 5A shows a first flow chart of a control program for a steam iron according to the invention.
Figure 5B:
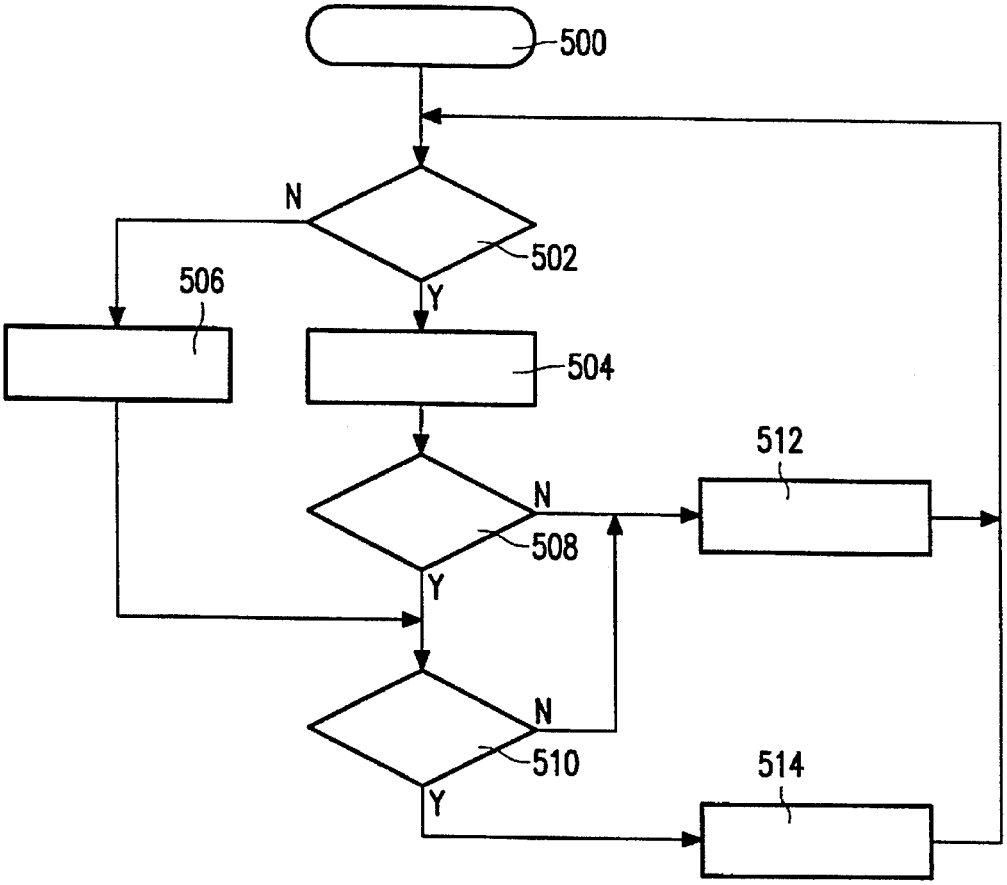
FIG. 5B shows a second flow chart of a control program for a steam iron according to the invention.

The power control can be done conventionally or using fuzzy logic in response of the temperature of the fabric and the temperature gradient of the fabric and can be combined advantageously with the controlled steam production. The combined steam and power control may proceed for example according to the flow charts given in FIG. 5A for one fabric temperature sensor and in FIG. 5B for two fabric temperature sensors. The inscriptions to FIGS. 5A and 5B are listed in Table I. $T_f$ and $T_{f1}$ are the temperatures sensed by the only or first sensor 24 (FIGS. 2 and 4) and $T_{f2}$ is the temperature sensed by the second sensor 30 (FIG. 4 only).

| Block | Inscription FIG. 5A | Inscription FIG. 5B |
|---|---|---|
| 500 | Start | |
| 502 | $T_f > 95°$ C. | $T_{f1} > 95°$ C. |
| 504 | Steam production down | |
| 506 | Steam production up | |
| 508 | $T_f < 125°$ C. | $T_{f1} < 125°$ C. |
| 510 | | $T_{f2} < 125°$ C. |
| 512 | Soleplate heating power down | |
| 514 | Soleplate heating power up | |

The temperature $T_f$ or $T_{f1}$ of the fabric is measured by sensor 24 (block 502). If the fabric temperature is lower than 95° C., the steam production is enabled (block 506). If the fabric temperature is higher than 95° C., then the steam production is disabled (block 504) and the fabric temperature $T_f$ is compared with 125° C. using one sensor 24 (block 508) or two sensors 24 and 30 (block 508/510). The soleplate heating power is shut off (block 512) when the desired 125° C. is reached, otherwise the power of the soleplate is switched on (block 514). When two fabric temperature sensors are employed, the highest of the two temperatures $T_{f1}$ and $T_{f2}$ determines the fabric temperature as shown in FIG. 5B. A motion direction sensor may be incorporated to discriminate between backward and forward movement of the soleplate.

Figure 6:
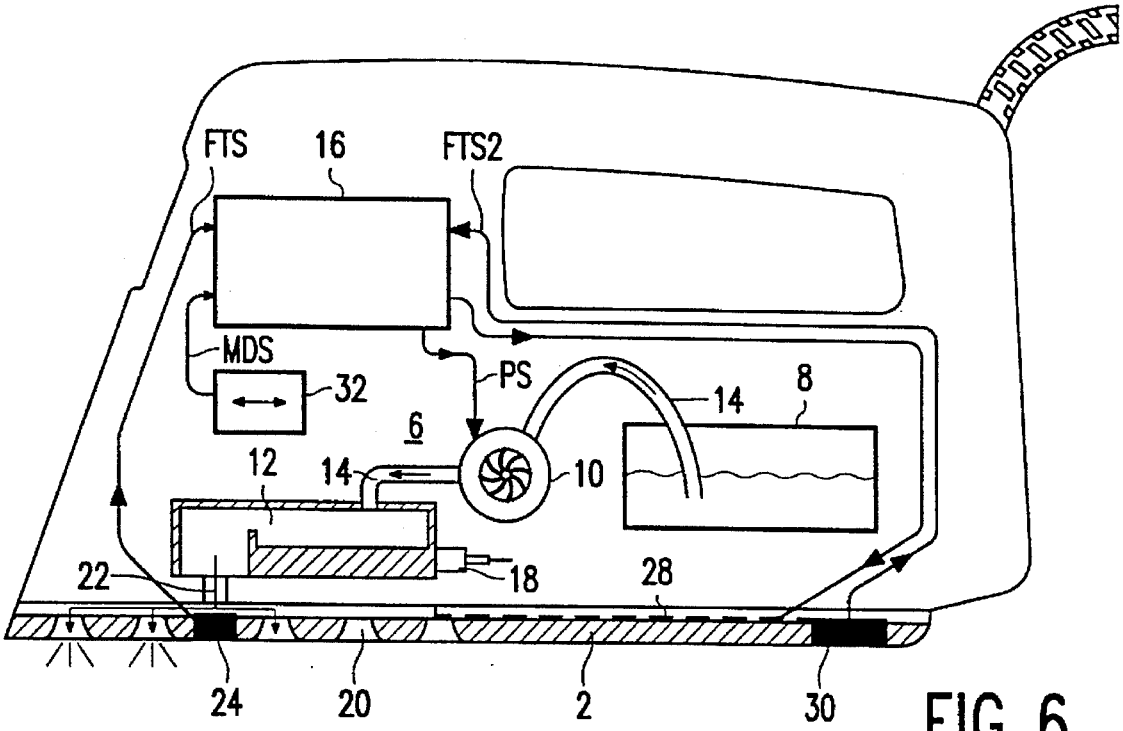
FIG. 6 shows schematically a cross section of a second embodiment of a steam iron according to the invention.

FIG. 6 shows a steam iron with a low thermal inertia soleplate 2 heated by a thick film heater 28 for controlled heating of the soleplate 2. The iron is provided with a second fabric temperature sensor 30 in the back portion of the soleplate 2 as already shown in FIG. 4. The hot steam chamber 12 is thermally detached from the soleplate 2 to prevent as much as possible heating of the soleplate 2 by the steam chamber 12. An optional motion direction sensor 32 provides a motion direction signal MDS to the (fuzzy) controller 16, which receives a second fabric temperature signal FTS2 from the second fabric temperature sensor 30. The main advantage of the low inertia soleplate 2 is that a very fast change in heat transfer is possible from the soleplate 2 to the fabric which is being ironed. If the steam generation capacity of the steam generator 6 and the drying power of the soleplate 2 are both sufficient, then it is possible to moisten and to heat up a cool cloth fully by means of (fuzzy) controlled condensing steam in the first forward stroke and thereafter to fully dry the cloth by means of (fuzzy) controlled heating power of the soleplate in the first backward stroke. Since the soleplate cools down very fast, the next cloth is mostly heated up by condensing steam and minimally by heat from the soleplate. This provides a very good ironing result, since the fibres in the cloth are weakened optimally by the condensing steam. In addition, the ironing procedure is fast and needs less water, steam and power.

Figure 7:
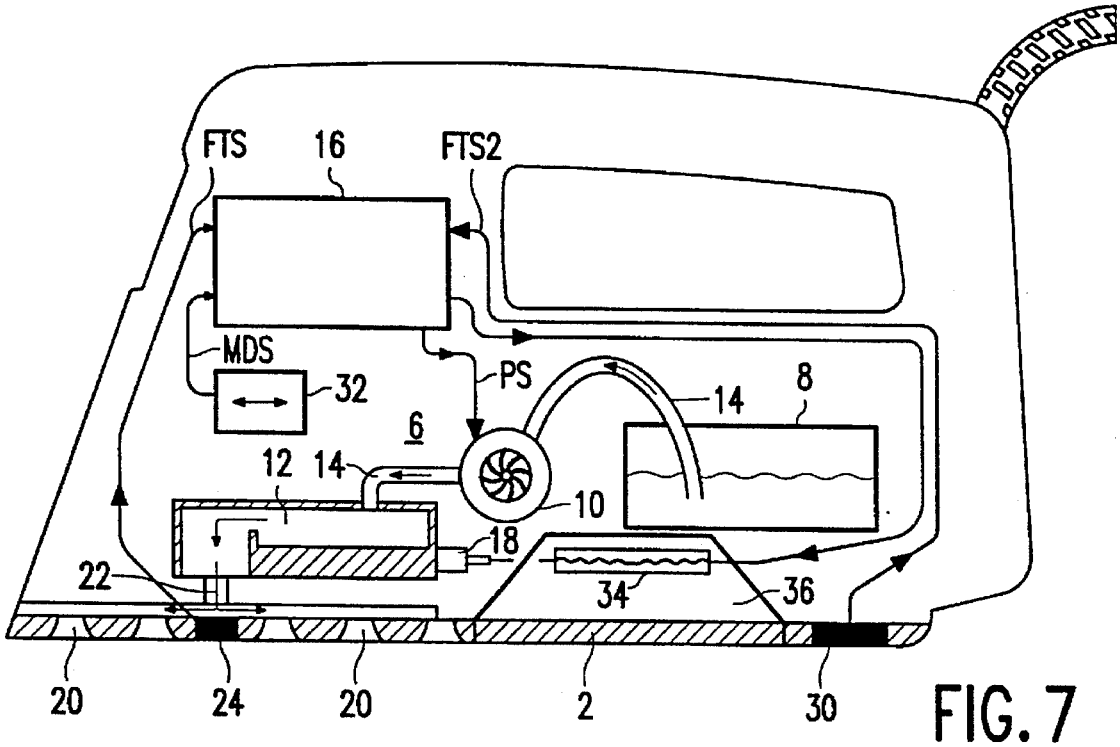
FIG. 7 shows schematically a cross section of a third embodiment of a steam iron according to the invention.

FIG. 7 shows another embodiment of a steam iron according to the invention. This embodiment differs from the embodiment of FIG. 6 in that the drying heat is supplied by infra red radiation of halogen light. For this purpose a halogen lamp 34 and a reflector 36 are mounted inside the steam iron and extend parallel to the plane of the soleplate 2. Underneath the reflector 36 the soleplate 2 is made transparent for the light emitted by the lamp 34.

The steam generator 12 should be capable of fast production of a large amount of steam. For this purpose the steam chamber 12 should have a high heat capacity to be able to evaporate large amount of water in a short time, a small air volume to reduce the response time, a large evaporating area to enhance steam production and the steam duct volume should be as small as possible. Suitable dimensions are about 7*10*4 $cm^3$ (l*w*h), an evaporating area of 60 $cm^2$ and a height of a few millimeters and the heating element 18 should have a capacity of about 800 W.

Disclosed are examples of steam irons having an electrically heated soleplate (2), a steam generator (6) comprising a water tank (8), a water pump (10) and a steam chamber (12) for supplying steam via steam vents (20) in the soleplate (2). The steam production is made dependent on the temperature of the fabric by means of a fabric temperature sensor (24) embedded in the soleplate (2). A cool fabric triggers the production of steam. The production is stopped as soon as the fabric temperature reaches the condensing temperature of steam. Since no more steam is absorbed in the fabric when the condensing temperature is reached, any more steam production is waste of water and power. In this way any further steam production is prevented and waste of water and power is avoided. After steaming has stopped the fabric temperature sensor (24) can be advantageously used to control the drying power of the soleplate (2) to avoid scorching of the fabric and to avoid waste of power. The steam control and the power control may be conventional or fuzzy. The soleplate can be of a conventional or a low heat inertia type. Two or even more than two fabric temperature sensors embedded in the soleplate may be employed.

Other features may be incorporated in the steam iron to enhance the performance. The optional motion direction sensor 32 can also be used as movement sensor to detect whether the iron is being moved or not. If not moving, the steam production and the power of the soleplate can be shut off to prevent scorching. A sensor in the handgrip of the steam iron may be provided to detect whether the iron is in use or not.

We claim:

1. A steam iron comprising a soleplate (2) provided with steam vents (20) for passing steam to a fabric to be ironed and a steam generator (6) comprising a water tank and a steam chamber (12) for supplying an adjustable amount of steam to the steam vents (20), wherein the steam iron further comprises a fabric temperature sensor (24) for detecting the temperature of the fabric to be ironed and control means (16) responsive to a signal (FTS) from the fabric temperature sensor (24) for controlling the amount of steam generated in the steam generator and passing to the steam vents (20).

2. A steam iron as claimed in claim 1, characterized in that the fabric temperature sensor (24) is embedded in the soleplate (2) and has a temperature sensitive surface which touches the fabric during ironing.

3. A steam iron as claimed in claim 2, characterized in that the fabric temperature sensor (24) is positioned in the front portion of the soleplate (2) nearby the steam vents (20).

4. A steam iron as claimed in claim 1, characterized in that the control means (16) are operable to pass steam to the steam vents (20) until the fabric temperature sensor (24) signals the reaching of a first predetermined temperature.

5. A steam iron as claimed in claim 1, characterized in that the first temperature is the condensing temperature of the steam.

6. A steam iron as claimed in claim 1, characterized in that the first control means (16) are responsive to the momentary value and the gradient of the signal (FTS) from the first fabric temperature sensor (24).

7. A steam iron as claimed in claim 6, characterized in that at least one of the first and second control means (16) is responsive according to fuzzy logic.

8. A steam iron as claimed in any of the preceding claims, characterized in that the steam iron further comprises a heating element (4) for heating the soleplate (2) and second control means (16) responsive to the signal (FTS) from the fabric temperature sensor (24) for controlling the amount of heat produced by the soleplate (2).

9. A steam iron as claimed in claim 8, characterized in that the second control means (16) are operable to control the heating of the soleplate (2) until the fabric sensor (24) signals the reaching of a second predetermined temperature above the first temperature.

10. A steam iron as claimed in claim 9, characterized in that the second temperature is lower than the scorching temperature of the fabric.

11. A steam iron as claimed in claim 8, characterized in that the soleplate (2) is a low heat capacity type soleplate.

12. A steam iron as claimed in claim 11, characterized in that the soleplate (2) is heated by means of light energy produced by a lamp (34) in the steam iron.

13. A steam iron as claimed in claim 8, characterized in that the steam iron comprises a second fabric temperature sensor (30) for sensing the fabric temperature at the back portion of the soleplate (2).

14. A steam iron as claimed in claim 8, characterized in that the second control means (16) are responsive to the momentary value and the gradient of at least one of the signal (FTS) from the first fabric temperature sensor (24) and the signal (FTS2) from the second fabric temperature sensor (30).

15. A steam iron comprising a soleplate provided with steam vents for passing steam to a fabric to be ironed and a steam generator for supplying an adjustable amount of steam to the steam vents, wherein the steam iron further comprises a fabric temperature sensor for detecting the temperature of the fabric to be ironed and control means responsive to a signal from the fabric temperature sensor for controlling the amount of steam passing to the steam vents, and wherein the steam generator comprises a water tank for containing water to be converted into steam, a steam chamber for converting the water into steam and a water pump for pumping water from the water tank to the steam chamber, the water pump being operable in response to a pump activation signal derived from the signal from the fabric temperature sensor.

16. A steam iron comprising a soleplate provided with steam vents for passing steam to a fabric to be ironed and a steam generator for supplying an adjustable amount of steam to the steam vents, wherein the steam iron further comprises a first fabric temperature sensor for detecting the temperature of the fabric to be ironed, a second fabric temperature sensor for sensing the fabric temperature at the back portion of the soleplate, and control means responsive to a signal from the fabric temperature sensor for controlling the amount of steam passing to the steam vents, and wherein the steam iron further comprises a motion direction sensor for discriminating motion in the forward and backward direction of the iron, the second control means being responsive to the signal from the first fabric temperature sensor during motion in the backward direction and being responsive to a signal from the second fabric temperature sensor during motion in the forward direction.

* * * * *